US005107714A

United States Patent [19]

Lamaignere

[11] Patent Number: 5,107,714

[45] Date of Patent: Apr. 28, 1992

[54] RELEASABLE MECHANICAL ABUTMENT

[75] Inventor: Charles Lamaignere, Paris, France

[73] Assignee: Euphya, Paris, France

[21] Appl. No.: 536,642

[22] PCT Filed: Nov. 20, 1989

[86] PCT No.: PCT/FR89/00597

§ 371 Date: Jul. 26, 1990

§ 102(e) Date: Jul. 26, 1990

[87] PCT Pub. No.: WO90/05949

PCT Pub. Date: May 31, 1990

[30] Foreign Application Priority Data

Nov. 22, 1988 [FR] France ..... 88 15165

[51] Int. Cl.[5] ..... G05G 17/00; H01H 13/36

[52] U.S. Cl. ..... 74/2; 74/97.2; 74/100.2; 74/106

[58] Field of Search ..... 74/2, 97.2, 100.2, 106, 74/520; 267/158, 159, 160, 164

[56] References Cited

U.S. PATENT DOCUMENTS

| | | | |
|---|---|---|---|
| 2,253,552 | 8/1941 | Burch | 74/97.2 |
| 2,266,537 | 12/1941 | Elmer | 74/97.2 X |
| 2,428,172 | 9/1947 | Miller | 74/97.2 X |
| 2,429,074 | 10/1947 | Rugh | 74/97.2 X |
| 2,468,673 | 4/1949 | Kaminky | 74/97.2 X |
| 2,521,015 | 10/1950 | McLaren et al. | 74/97.2 |
| 2,669,618 | 2/1954 | Bradley | 74/100.2 X |
| 2,968,708 | 1/1961 | Sagona | 200/113 |
| 3,050,599 | 8/1962 | Brevick | 200/67 |

FOREIGN PATENT DOCUMENTS

| | | | |
|---|---|---|---|
| 2744963 | 4/1979 | Fed. Rep. of Germany . | |
| 881716 | 11/1981 | U.S.S.R. | 74/97.2 |

*Primary Examiner*—Allan D. Herrmann
*Assistant Examiner*—Julie Krolikowski
*Attorney, Agent, or Firm*—Roland Plottel

[57] ABSTRACT

A releasable mechanical abutment consisting of a profile made of a resilient, thin, and elongated material (1, 30, 42, 70, 90, 107) at least partly bent over itself along a longitudinal axis, a force or effort being applied and exerted on ends of the profile, and at least one triggering element (22, 46, 64, 76, 93, 113) adapted for acting generally perpendicularly on one or several determined sections (10, 38, 50) of the profile by creating a deformation of the profile which materializes a preferential flexural zone, in a manner that abrupt buckling of the profile according to the zone and section is such that it does not exceed the resilient limit of the material, and causes the immediate relaxation of the applied force or effort.

16 Claims, 6 Drawing Sheets

RELEASABLE MECHANICAL ABUTMENT

BACKGROUND OF THE INVENTION

The present invention relates to a mechanical abutment, adapted for being released under the action of a control element using a very small energy and the operation of which uses the property of a flexible profile to buckle under the effort to which the abutment is subjected, by deformation and bending of one at least of its sections.

DISCLOSURE OF THE PRIOR ART

Many embodiments of mechanical abutments are already known, used notably in some differential electrical switches or in hooking systems, in which an energy accumulator, usually a strongly compressed spring, is abruptly released for acting on a mechanism the operation of which fulfills a safety function (opening of a relay, interruption of a circuit, operation of a latch, casting-off of a load or of a previously immobilized element . . . ). The charge applied to the spring is generally maintained by a bearing member forming an abutment, which can abruptly retract under the effect of a control element actuated once it has passed beyond a predetermined set threshold by a given value, measured permanently and adapted in particular for providing the effort necessary for the control element. The latter is termed generally in the following description as "triggering element". Various embodiments of such triggering elements to be used as switches or circuits breakers are shown in U.S. Pat. No. 2,968,708, DE-A-2 744 963 and U.S. Pat. No. 3,050,599.

On the other hand, it is a standard mater to provide means for a demultiplication of the control effort of the abutment, made for example of a set of levers or of toggle joints; the triggering element may be then made of any appropriate device, of thermal (bimetallic strip), electrical (electromagnetic relay), or mechanical origin (lever, clamp . . . ), for providing as a function of the measured value an effort which is minimum but sufficient for producing, once the set value has been passed, the liberation of the abutment and the release of the compressed spring.

But all these standard systems require many parts for making them, the structure of which is generally complex and which increase substantially the cost price, with moreover a response time which is not always instantaneous between the action of the triggering element and the liberation of the abutment, due in particular to the necessary transmission and demultiplication of the movements.

FIELD OF THE INVENTION

The present invention relates to a releasable mechanical abutment avoiding these disadvantages due to the use of a flexible profile having, with respect to the compression effort which is exerted on the abutment, a high rigidity, together with a large buckling capacity, allowing the instantaneous release of said effort by retraction of the abutment under the effect of a triggering element, requiring for being used only a minimum effort, and therefore a very reduced control energy.

In other words, the gist of the invention lies in the design of a mechanical abutment of great rigidity but capable of retracting instantaneously upon a minimum mechanical energy application, which can notably be provided by or from the measured value as such when it passes beyond a predetermined threshold, whereby the retraction of the abutment can moreover act, if need be, on means adapted for bringing said value within the adopted set threshold.

On the other hand, its object is, due to the use of single mechanical part having at least one flexural preferential section, adapted for initiating the buckling and retraction effect of the abutment, to provide an assembly where the releasing energy does not depend, or only in a negligible way, on the abutment effort as such, where no significant overload is involved for this release and which ensures an automatic resetting without any dead point to be passed, the flexible profile returning to its initial position as soon as the abutment effort has stopped, which has a reduced mass in movement and is finally practically independent of the outer conditions for its response.

To this effect, the releasable mechanical abutment in consideration is characterized in that it is made of a profile in a resilient, thin and elongated material, at least partly curved over itself along a longitudinal axis, the abutment effort being exerted on the ends of the profile, and of at least one triggering element, adapted for acting on one or several determined sections of the profile, by creating a deformation of the latter which materializes a preferential flexural zone, in such manner that the abrupt buckling of the profile according to this section which is such that it does not exceed the resilient limit of the material, causes the immediate relaxation of said effort.

The resilient material forming the profile is preferably a spring steel, but could also be made of another material, metallic or composite, notably based on resistant fibres imbedded in a plastic material, having in all cases a resilient limit such that, once the abutment effort is cancelled, the profile resumes its initial shape.

The triggering element may be constituted by any device, known per se, transforming the energy of the value monitored, beyond a predetermined set value, into a mechanical energy transmitted to a control member acting on the profile preferential section in order to bring it in conditions of lesser resistance where its buckling can immediately occur.

Eventually, the abutment effort can be such that it initiates directly the buckling of the profile, in the absence of an action of the triggering element, notably when it exceeds the flexural strength limit of the profile.

In virtue of these dispositions and within the scope of the operational principles thus defined, it is of course possible to envisage any variant as regards the shape of the profile, the material or materials of which it is made, its deformation mode and therefore the process of its release. Notably and in a particular embodiment, the profile is made of a tube, of reduced thickness, the triggering element being provided by variation of pressure of a fluid, preferably a liquid contained inside the tube.

Generally, the triggering of the profile consists in a determined action, adapted for reducing the buckling strength by crushing or deforming one at least of its sections, reducing locally its bending. Under such conditions, two release modes of the profile can be envisaged; in one of them, the triggering element crushes a section of a profile, bent over all its length, while in the other, the preferential section is maintained bent, the profile being plane when at rest in this section and bent in the rest of its surface while the triggering element is arranged for causing the relaxation of this preferential section, the profile being crushed of its own and authorizing its buckling.

In the profile, one defines notably what will be called in the remaining description the axis of reaction, made of the geometric locus of the centers of gravity of the successive sections of the profile, from one of its ends to the other. According to the invention, in the set or engaged in position, the axis of reaction is substantially a straight line parallel to the direction of the compression effort created on the profile by the abutment on the major portion of its length. Likewise, the means fibre of the profile, considered in each of its sections, is generally a curve. Under these conditions, when the release takes place, this mean fibre becomes more and more open in the vicinity of this sensitive section, as the crushing proceeds. Likewise, the axis of reaction is deformed in the vicinity of this sensitive section and the distance separating it from the abutment effort direction varies so as to get nearer or further away from it.

The profile thus set, mounted between both its end studs, resists then to buckling due to the fact that it has a high flexural moment of inertia, and behaving in this case as a beam compressed between the two studs. The distance separating its axis of reaction from the direction of the effort creates a torque which is all the more limited that this distance is smaller, while establishing however a preferential buckling direction.

The action of the triggering element consists then in reducing by crushing the flexural moment of inertia of the profile as its preferential section becomes and more a straight line.

Simultaneously, and in various alternative embodiments where the profile has a simple curvature, its axis of reaction in register with this section gets deformed so as to get nearer or further away from the effort direction.

The buckling occurs as soon as the deformation of the axis of reaction in the vicinity of this preferential section is such that it creates a flexural torque sufficient for initiating this buckling, by causing then instantaneously the release of the abutment.

Thus, in a particular embodiment which improves substantially the stability, the profile can be mounted in such manner that its buckling preferential direction in the set position brings it to bear on a fixed portion or on the triggering element as such, and in such manner that the triggering element compels the axis of reaction to cross the direction of the abutment effort, the inversion of the flexural stress direction created on the profile causing immediately the desired buckling.

In various alternative embodiments, the capacity of the profile to get straight again and to reset the abutment in an autonomous way can be used so as not to necessitate any outer action for the resetting of the device, or only a very small action. In particular, this resetting can be achieved by a limited effort on the central portion of the profile.

According to a particular feature of the invention, the bent profile is held between two studs at its ends and is bearing via one of them on a ball or on a cutter facilitating its buckling after its release by a reduction of the residual flexural stresses in the vicinity of this end. As a variant, one at least of the ends of the bent profile is imbedded in a flexible material, of the glue or resin type, distributing in a more homogeneous way the abutment effort on this end.

According still to another feature of the invention, the bent profile forming the abutment is made lighter in register with its preferential section, notably by forming in the profile a median hole or by providing symmetrical notches on its side edges so as to maintain the center of gravity of the section substantially in the center of the latter. This operation carried out on one end can even allow, without manufacturing difficulties, obtaining a flexible articulation applying in an accurate manner the abutment effort at a determined distance of the axis of reaction. Notches provided on the end edges of the profile can eventually be used as a housing for setting in position a bearing axis for the profile, on which is applied the abutment force or effort.

According to a variant, the profile ends are imbedded inside arms articulated on support studs, adapted for being operated along an axis perpendicular to the plane of the preferential section on either side of which the buckling occurs, said arms increasing the profile rigidity and the extent of its flexural excursion.

Advantageously, the preferential section is placed in the vicinity of one profile end.

In a particular embodiment, the profile is associated with a resetting member, eventually in two parts forming a toggle joint and the arms of which, when are conformed according to the curvatures of the bent profile, bear on the latter so as to make it straight again after buckling.

FIGS. 13, 14 and 15 are perspective views showing stages of a profile configured in tubular configuration in respective "ready", "action while releasing", and "released" positions, in which a valve provides control of the condition of the tubular profile.

DESCRIPTION OF THE SEVERAL FIGURES OF THE DRAWING

Other features and advantages of a mechanical abutment made according to the invention will become more apparent from the following description of several embodiments, given by way of an indication and not limiting, with reference to the accompanying drawings wherein:

FIG. 5 shows schematically another embodiment, with the profile according to FIG. 1 in a position for maintaining the abutment (FIG. 5) and in a position for liberating this abutment (FIG. 6).

DETAILED DESCRIPTION OF THE PREFERRED EMBODIMENT

Figure 1:
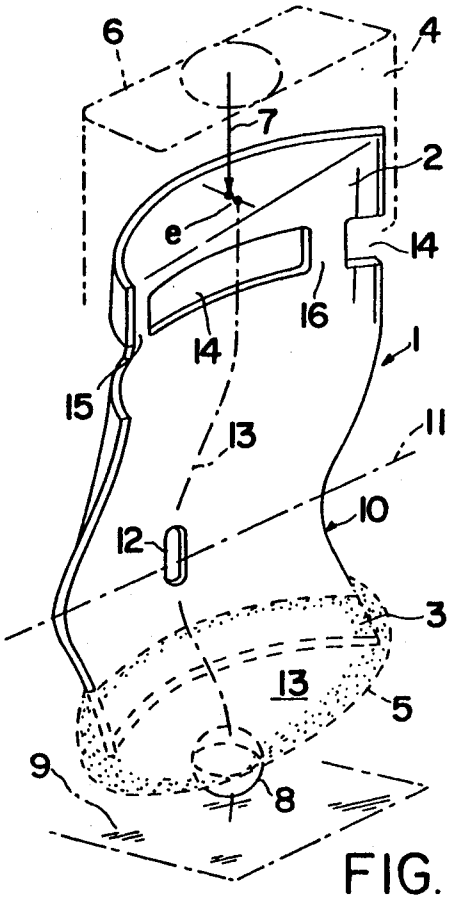
FIG. 1 is a perspective view of a first embodiment of a thin profile partly bent over itself and having a preferential flexural section when at rest, which is part of a mechanical abutment according to the invention.

In the embodiment shown in FIG. 1, the mechanical abutment in consideration is made substantially of a metallic profile 1, having the shape of a thin metallic blade, bent over itself in the vicinity of its ends 2 and 3. The end 2 is imbedded in a support 4 of general parallelepipedal shape in the embodiment shown, while its end 3 is set inside a block 5 of an appropriate material of the hardened resin type. Support 4 includes an upper plane face 6 against which is exerted a given abutment force or effort, the direction of which is shown schematically by arrow 7. At the opposite, block 5 is associated with a ball 8, which is slightly protruding outside in order to come to bear on a plane surface 9, the reaction on the latter being exerted in the direction reverse to that of the abutment effort 7. The ball 7 facilitates the buckling under the releasing effort.

Profile 1 thus bent includes, when at rest, a preferential flexural section 10 on which the curvature or mean fibre of the profile is deformed so as to become nearly a straight line 11. Advantageously, the profile includes in section 10 a reduction of its surface, particularly one or several holes such as 12, preferably formed in the center of the profile or symmetrically with respect to its median plane so that its center of gravity in register with this section remains in this plane.

In the drawing, reference 13 denotes what can be called the axis of reaction of profile 1, made by the geometric locus of the centers of gravity of the successive sections of this profile, from one end to the other of the latter. Axis 13 is thus parallel to the direction 7 of the abutment effort, notably in the portions of the profile which are bent regularly and in an identical way, in the vicinity of its ends, the distance separating axis of reaction 13 from direction 7 of the effort being shown schematically in the drawing by reference e. When the profile is at rest, axis 13 flexes as one comes nearer to section 10 so as to reach the latter and as near as possible of the transverse axis 11 materializing the maximum profile deformation. When this profile is set, all its sections are bent in an identical way and its axis 13 is then a straight line.

Advantageously, there is provided in profile 1, notably in the vicinity of its upper end 2 on which the abutment effort is applied, recessed portions such as 14, formed in the central portion and eventually in the side portions of the profile, these recesses being defined by arms, respectively 15 and 16, symmetrical with respect to the profile median plane and authorizing the effort in the direction of arrow 7 in the desired position.

Figure 2:
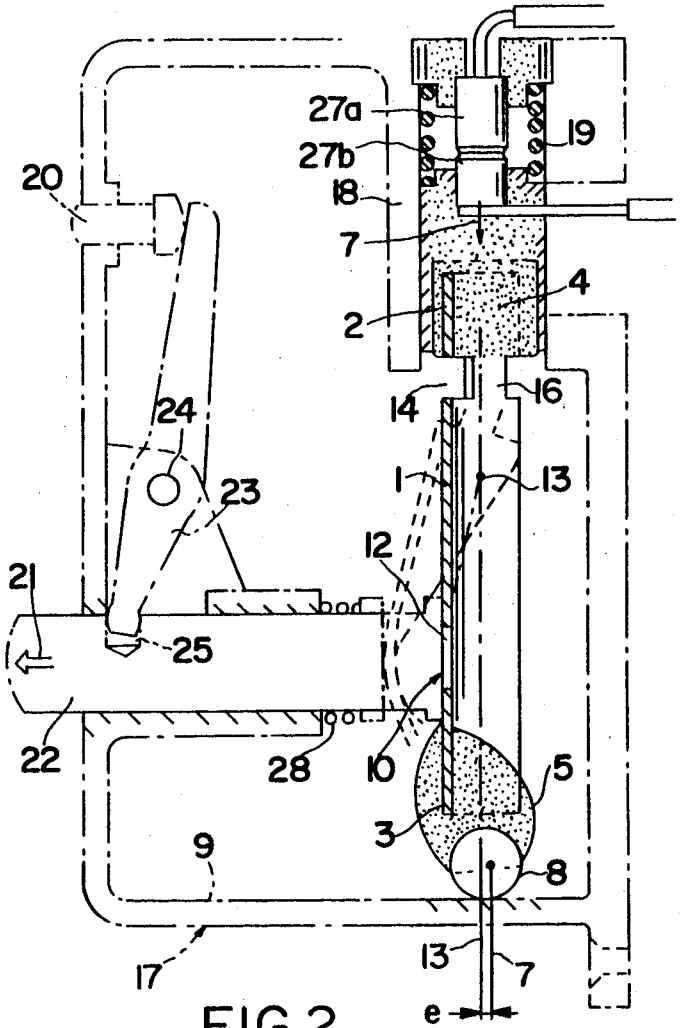
FIG. 2 is a transverse sectional view of an embodiment of a mechanical abutment using the bent profile according to FIG. 1.

In the device illustrated in FIG. 2, the profile 1 hereabove described is shown mounted inside a casing 17. The support 4 provided at the upper end 2 of the profile is slidably mounted inside an appropriate housing, defined by an edge 18 of the casing wall, and is subjected to the action of a spring 19 exerting the abutment effort in the direction of arrow 7 and having a mobile contact 27*a* bearing on a fixed contact 27*b* rigidly connected to casing 17. The bottom of the casing forms the bearing surface 9 for ball 8. In the drawing, there has also been shown the axis of reaction 13 and the distance e separating the latter from the direction 7 of the effort exerted on the profile.

According to the invention, profile 1 is associated with a triggering element which, in the example in consideration, is made of a transverse rod 22 adapted for being subjected to a displacement in the direction of arrow 21, notably for exerting a limited effort on the profile in its preferential flexural zone. Rod 22 cooperates with a lever 23 articulated about an axis 24. Lever 23 extends at one end into a notch 25 of rod 22 and bears at its opposite end on a releasing button 20. Spring 28 presses permanently rod 22 against profile 1 in contact with the surface of its section 10 and bends it in order to straighten up its axis of reaction 13.

In the set position shown in full lines in the drawing, profile 1 is not bent about its section 10 and maintains contacts 27*a* and 27*b* applied one against the other with a large force. The effort in the direction of arrow 7 due to spring 19 is entirely supported by the profile, which opposes thus any liberation of the system.

The triggering element thus designed allows, by a very small action exerted on button 20, pushing back rod 22, letting the preferential section 10 straightening back and causing then in an instantaneous manner the buckling of profile by a flexure of the latter about the transverse axis 11. During this movement, profile 1 pushes back rod 22 as against spring 28 while separating abruptly contacts 27*a* and 27*b*.

The resetting of the abutment can be effected by applying on the end of rod 22 which protrudes outside the casing the necessary effort, bringing profile 1 back to its initial position where, due to its inherent rigidity, it opposes the effort created by spring 19, until a new intevention of the triggering button 20.

Figure 4:
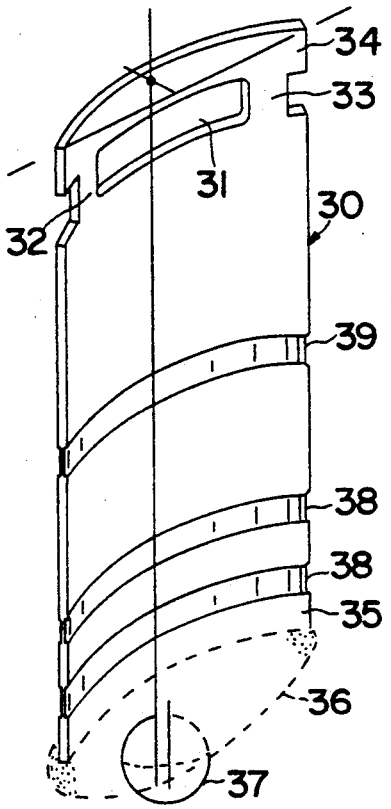
Figure 3:
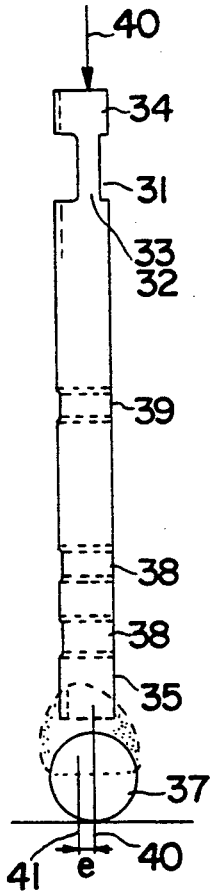
FIG. 3 is a side view of an alternative embodiment where the profile is bent over all its length.

FIGS. 3 and 4 show an alternative embodiment of the metallic profile, denoted here by reference 30. It is made again of a thin metallic element, bent over itself and including recesses 31 defining arms 32 and 33 in the vicinity of one of its ends 34 while the other end 35 is imbedded in a block 36 associated with a ball 37. The ball 37 facilitates the buckling under the releasing effort. The profile preferential flexural section is defined by lightened portions 38, in the surface of the profile, these lightened portions allowing reducing the residual effort during buckling. Other thinned out portions 39 can also be provided in other regions of the profile. In the drawing, reference 40 denotes the direction of the abutment effort, reference 41 the axis of reaction whose distance from the direction of effort 40 is again shown by reference.

In the first embodiment shown in FIG. 1, the metallic profile 1 has, when at rest, a substantially plane shape, its ends 2 and 3 being forced and maintained bent by support 4 and block 5 at its ends. In the variant shown in FIGS. 3 and 4, profile 30 is on the contrary naturally bent, its deformation in its preferential flexural section 38 being obtained by an effort applied on the latter in order to bring it to a substantially plane shape.

Figure 5:
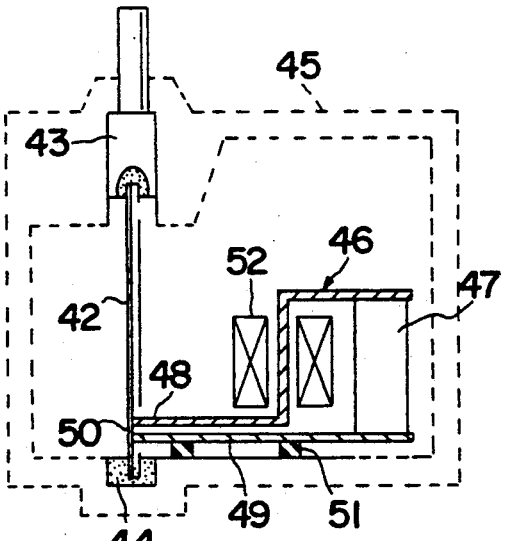
FIG. 5 is a perspective view of the alternative embodiment of FIG. 3.
Figure 6:
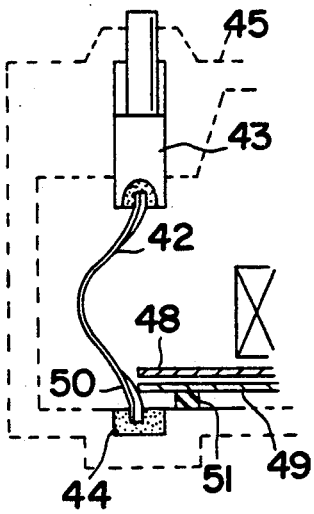
FIG. 6 shows schematically the embodiment of FIG. 5, but in a position for liberating the abutment.

In the embodiment shown in FIGS. 5 and 6, profile 42 whose characteristics are those of profile 1 of FIG. 1, has its ends maintained respectively in a bearing member 43 and in an immobilization block 44 inside a casing 45. As a variant, block 44 can be made of a glue or resin having an appropriate flexibility, imbedding the end of profile 42.

Triggering element 46 is made of a permanent magnet 47 against the poles of which is placed a metallic armature including two parallel extensions 48 and 49, defining between themselves an air gap normally closed by profile 42, in register with its preferential section 50. The whole of triggering element 46 thus made bears against the bottom of casing 45 on dampers 51, the armature being moreover associated with an electromagnetic coil 52. When at rest, magnet 47 attracts the preferential section 50 of profile 42, which is then plane, and bends it, the profile being thus set. The passage of a current in this coil modifies then the reluctance of the magnetic circuit, in such manner that the section 50 which is initially bent is partially relaxed and allows at a given moment the abrupt buckling of profile 41. FIG. 6 shows the position occupied by the latter, thereby causing the liberation of abutment member 43.

Figure 7:
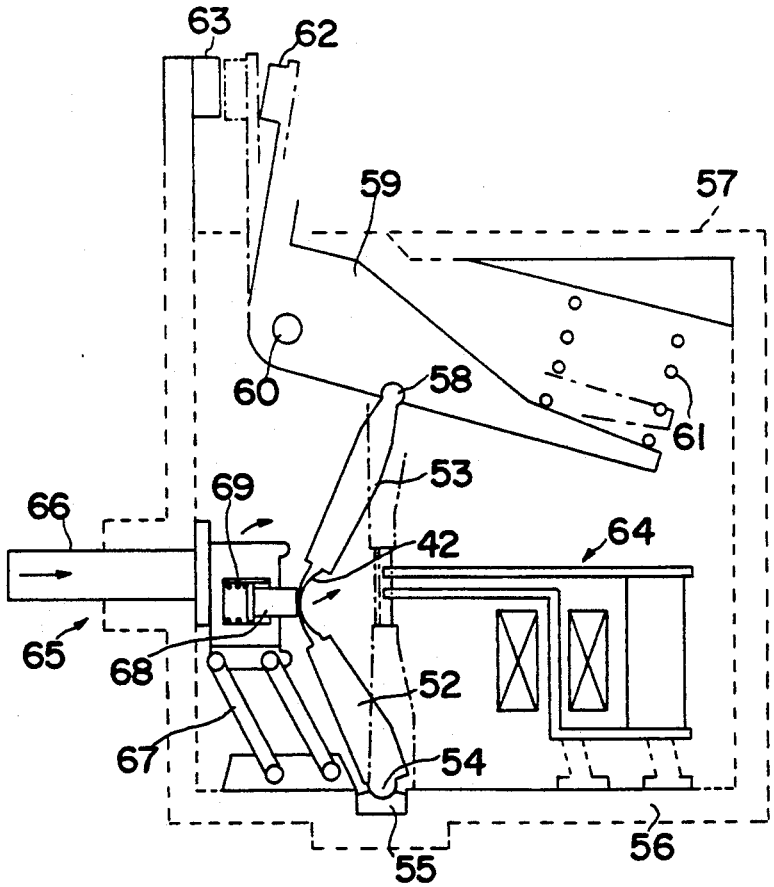
FIG. 7 shows a transverse a transverse sectional view of another alternative embodiment of a mechanical abutment mechanism according to the invention.

In another mechanism shown in FIG. 7, the flexible profile 42 has its ends imbedded into two fingers, respectively 52 and 53. At its opposite end, arm 52 includes a ball 54 supported by a bearing block 55, mounted in the bottom 56 of a casing 57. The other arm 53 includes likewise, at the opposite of the profile, a ball joint 58, adapted for cooperating with a lever 59 articulated on the one hand about an axis 60 carried by the casing, possibly mounted with a clearance in order to better distribute the efforts on the profile plane, the lever 59 being subjected on the other hand to the action of a return spring 61. Lever 59 includes an extension in which is mounted a contact stud 62, normally bearing against a homologous fixed stud 63 notably when profile 42 plays the role of an abutment opposing the pivoting of lever 59 due to spring 61. The apparatus includes likewise a permanent magnet triggering element 64, analogous to that already described in the embodiment of FIGS. 5 and 6 and the details of which, consequently, may not have to be explained again. Triggering element 64 which acts on profile 42 in a preferential flexural section of the latter allows as previously the buckling of the abutment by liberating lever 59 and disconnecting abruptly contacts 62 and 63.

The apparatus is also associated with a resetting assembly 65 including a push-button 66 carried by an articulated system 67, notably a deformable parallelepiped. Button 66 includes a push-piece 68 subjected to the action of a spring 69, allowing acting directly on profile 42 so as to straighten it and return it to its set position, the arms 52 and 53 being placed in the same direction.

Figure 8:
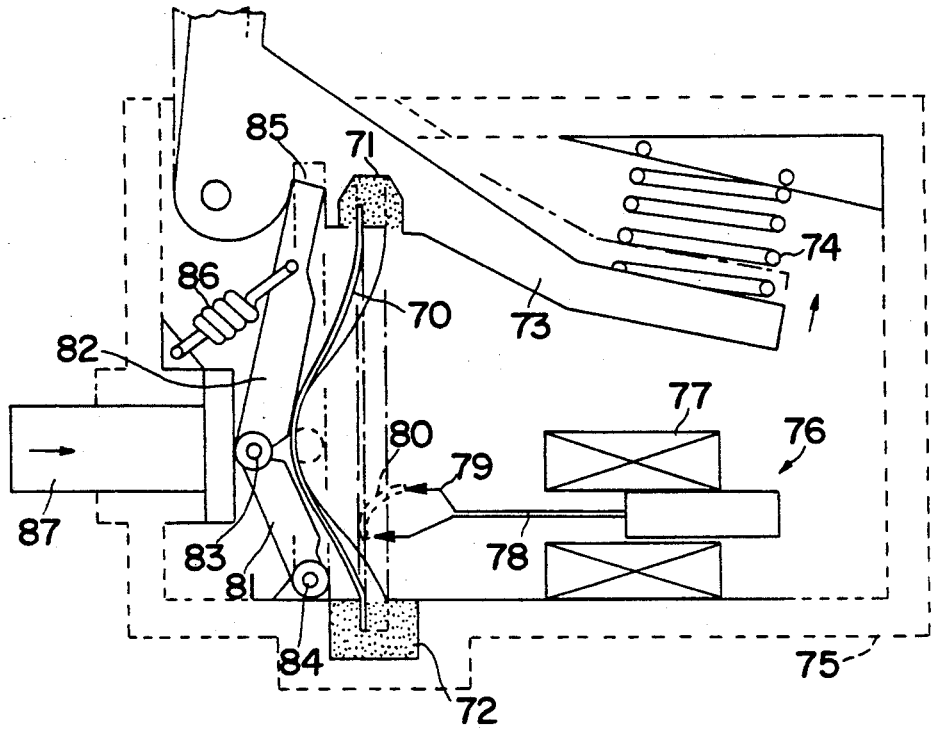
FIG. 8 shows a transverse sectional view of another alternative embodiment of a mechanical abutment mechanism according to the invention.

FIG. 8 illustrates still another variant, derived from the preceding one, where profile 70, which is in this case of the type of variant of FIGS. 3 and 4, is secured against motion by its ends in blocks 71 and 72, made of a resin or other material having an analogous relative flexibility, block 71 being part of a lever 73 subjected to the action of a spring 74 pivotably mounted inside a casing 75. Triggering element 76 has this time to crush the profile preferential section 80; it includes an electromagnet 77 in the coil of which is mounted in a movable core 78 activated by a controlled current flowing in the electromagnet extended by a fork 79 the ends of which come to bear against the edges of profile 70 in the region of its preferential flexural section 80 and when triggering element 76 is activated (moving to the left in the drawing of FIG. 8) it causes profile 70 to buckle (as shown in the heavy line in FIG. 8).

Profile 70 is again associated with a resetting device, made here of a toggle joint, including two small connecting rods 81 and 82, articulated on one another about an axis 83. Connecting rod 81 is in turn articulate don casing 75 about another axis 84, while connecting rod 82 has its end engaged inside a notch 85 of lever 73. A return spring 86 tends permanently to flex the toggle joint, while a button 87 allows ensuring the opening of the latter and bringing back the profile to its set position after deformation and flexure of the latter, provided by triggering element 76, its straightening up being permanently assisted by connecting rods 81 and 82 bearing on it.

Figure 9:
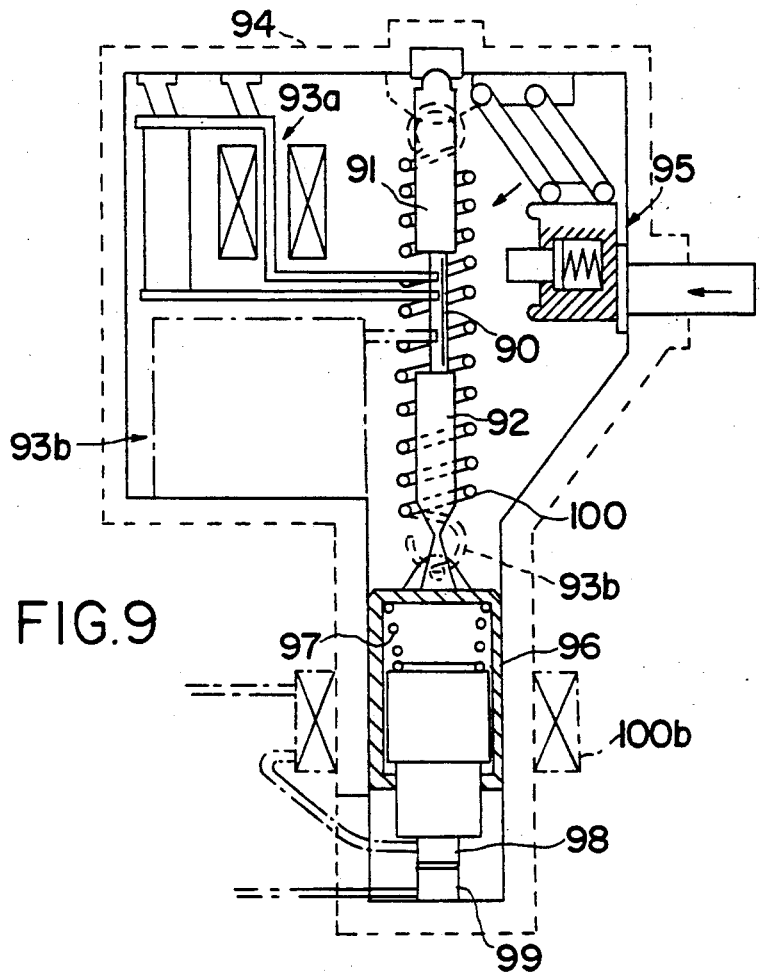
FIG. 9 shows a transverse sectional view of still another alternative embodiment of a mechanical abutment mechanism according to the invention.

FIG. 9 shows still another embodiment, also derived from the preceding ones. Profile 90 is rigidly connected at its ends to two pivoting arms 91 and 92, and is actuated by two triggering elements 93*a*, 93*b* of any type and deforming in the required manner two preferential sections of corresponding type, the assembly being mounted in a casing 94. A resetting button 95 allows bringing back the profile to its abutment position after buckling. The profile movement causes the release of a piston 96 provided with a spring 97, by authorizing, according to case, the contact or separation of the two studs 98 and 99. A traction spring 100*a* is mounted in the vicinity of the profile so as to maintain the contact studs 98 and 99 away from one another when the device is released. An electromagnet coil 100*b* through which passes the current flowing through studs 98 and 99 increases the effort exerted on profile 90 by attracting the mobile stud 98 and its control mechanism made of piston 96 and spring 97. When the current is too powerfull, profile 90 buckles abruptly due to an overload, thereby providing an extra safety with regard to a short-circuit current between studs 98 and 99.

Figure 10:
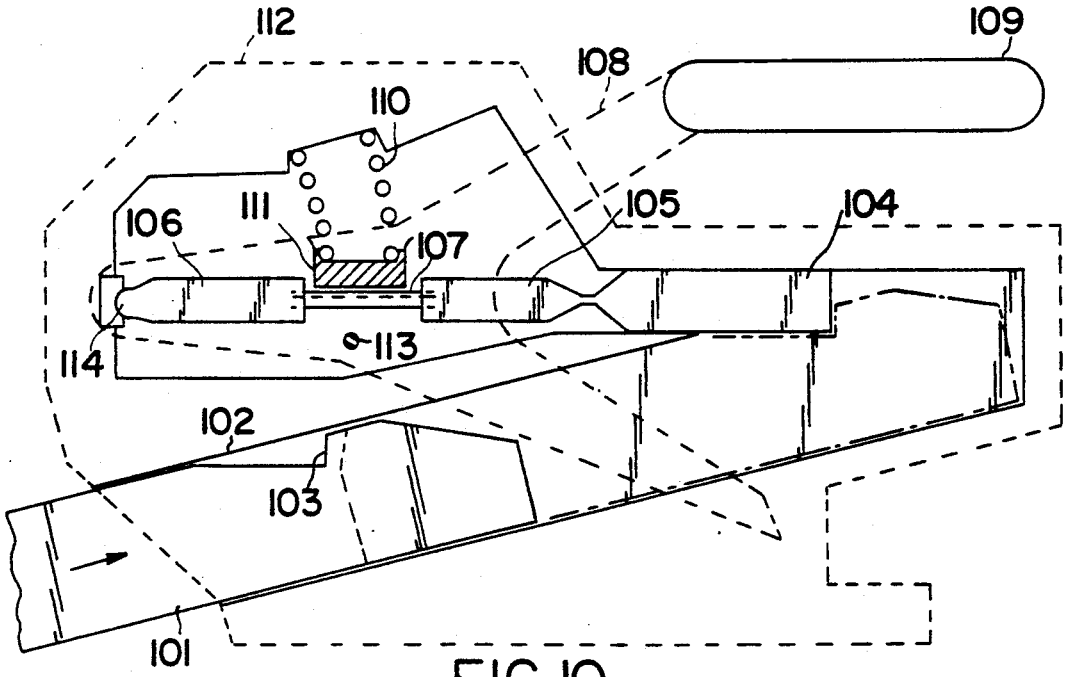
FIG. 10 shows still another embodiment where the abutment in consideration is more particularly adapted for immobilizing and freeing a castable member.
Figure 11:
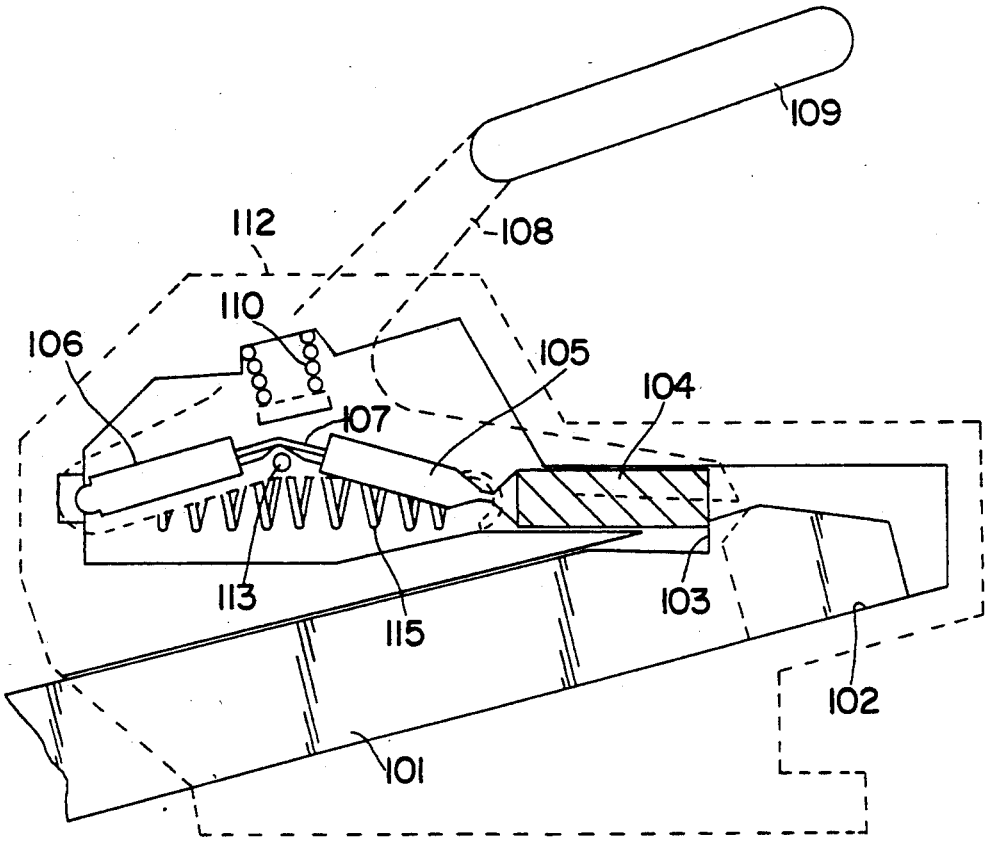
FIG. 11 shows the embodiment of FIG. 10 in a different position.
Figure 12:
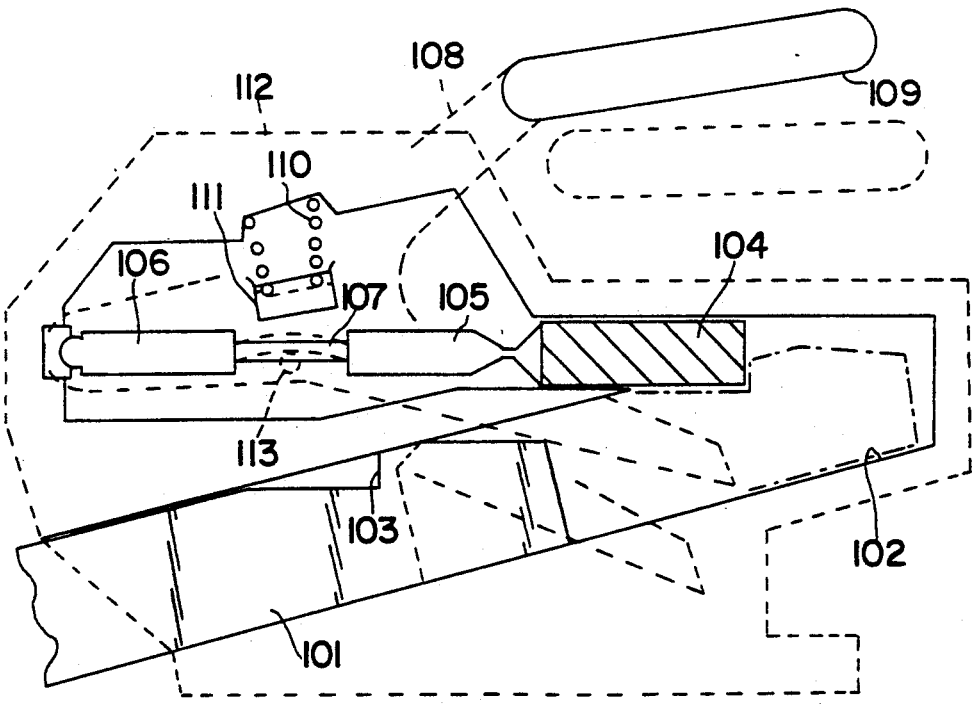
FIG. 12 shows the embodiment of FIGS. 10 and 11 in a still another position.

FIGS. 10 to 10 show another possible application of the device according to the invention, in which the releasable abutment according to the invention is used for securing against motion a sliding member 101, mounted in a mobile way in a housing 102, this member being formed with a notch 103 adapted for cooperating with a latch 104. The latter is tied to an arm 105 the connection of which with an homologous arm 106 is provided by a profile 107 according to the invention. The triggering element is made of a lever 108 provided with a resetting handle 109 and a spring 110, cooperating with a bearing end-piece 111 on profile 107, the assembly being mounted in a casing 112. Lever 108 includes a nib 113 and is mobile about the casing fixed point 114. Another spring 115 is provided for exerting permanently an action on latch 104 in the direction causing the abutment effort on profile 107.

In this embodiment, the sliding member 101 is engaged in the passage 102 of casing 112 and brought at the end of its stroke to the position shown in FIG. 10, where it is blocked by latch 104 engaged inside notch 103. The triggering element is made of a lever 108 which, when pivoting, causes the flexure of profile 107 under the effect of nib 113, the latch 104 disengaging then notch 103 under the effect of spring 115. The resetting of the system is effected by the effort due to spring 110, operating in a reverse direction lever 108 via its handle 109, during which time end-piece 111 straightens back the profile.

Figure 15:
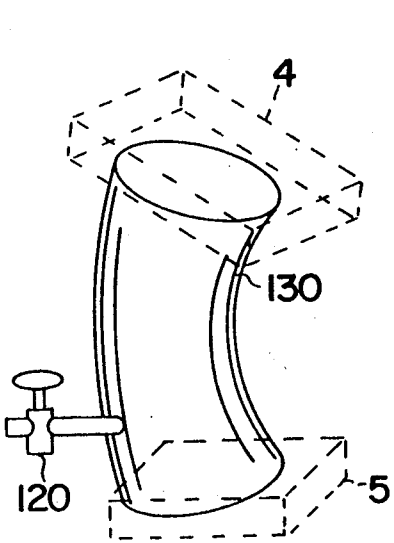
FIG. 15 is a schematic perspective view similar to FIGS. 13 and 14 and illustrating the apparatus in a released position.
Figure 14:
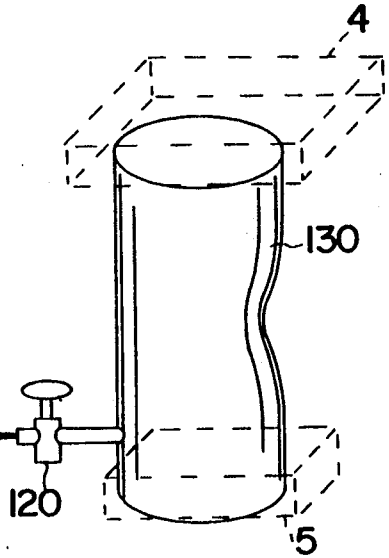
FIG. 14 is a schematic perspective view similar to FIG. 13 and illustrating the apparatus in a releasing position.
Figure 13:
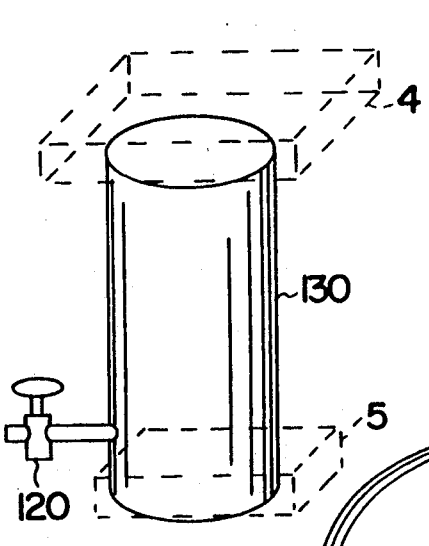
FIG. 13 is a schematic perspective view illustrating a principle of the invention when the apparatus of the invention is in a ready position.

Thus and whatever the embodiment adopted, there is provided a mechanical abutment system in which the profile opposes to the effort exerted on it a high rigidity while authorizing its buckling and therefore its practically instantaneous retraction, consecutively to the intervention of a releasing member using only a very small energy. This energy can be in particular, as may be suggested in FIGS. 13–15, be provided from a valve 120 connected to a tubular configured profile 130 which is monitored (not shown), as soon as the latter exceeds a determined set threshold. The system requires only a small number of parts including the tubular profile 130 in "ready" position (shown in FIG. 13), with very reduced masses in movement, necessitating at the moment of the release (shown in FIG. 14) of the abutment only a limited effort. The profile used can be easily reset after each release (shown in FIG. 15) without it being necessary to pass over a dead point. Finally, the assembly is practically independent as regards the outside conditions, particularly the temperature and possible vibrations, etc.

Of course and as results from the preceding, it goes without saying that the invention is not limited to the embodiments more especially described and shown hereabove; on the contrary, it encompasses all the variants thereof. In particular, when the profile has two side edges, as opposed to the particular case where it has a tubular configuration 130, the triggering element or valve 120 can act by pushing one point at least belonging to each edge, preferably on both of them, thus creating a mechanical effect adapted for initiating the buckling due the flattening of the profile and the initiating flexure resulting therefrom.

In that case, the action of the triggering element is preferably situated in the center of the profile, along its longitudinal extension.

What is claimed and desired to be secured by Letters Patent is:

1. A releasable mechanical abutment, comprising a profile (1, 30, 42, 70, 90, 107) consisting of a resilient, thin and elongated material having a longitudinal axis thereof and being at least partly bent over itself along the longitudinal axis, and having at least one of several determined sections (10, 38, 50) between ends of the profile, means applying force exerted on the ends of the profile, and at least one triggering element (22, 46, 64, 76, 93, 113) being adapted for acting generally perpendicularly upon a surface of the at least one of several determined sections (10, 38, 50) of the profile to provide a deformation of the at least one of several determined sections which materializes a preferential flexural zone, in such a manner that abrupt buckling of the profile according to the deformation of the at least one of several determined sections is that it does not exceed a resilient limit of the material, and the at least one triggering element including releasing means (20, 66, 87) for causing an immediate relaxation of the deformation.

2. A mechanical abutment according to claim 1, wherein the resilient material forming the profile is based on resistant fibers embedded in a plastic material, having in all cases a resilient limit such that, once the force of the applying means is cancelled, the profile resumes an initial shape.

3. A mechanical abutment according to claim 1, wherein the profile is maintained between two studs (4, 5) at its ends.

4. A mechanical abutment according to claim 1, wherein the profile is bearing at one of its ends on a ball (8, 37) facilitating the buckling under cause of the releasing means.

5. A mechanical abutment according to claim 1, wherein at least one of the ends of the profile is embedded in a flexible material distributing in a homogenous manner the force of the applying means on this end.

6. A mechanical abutment according to claim 1, wherein the bent profile forming the abutment is made lighter in register with its preferential zone by providing symmetrical notches (14) on side edges of the profile, so as to maintain a center of gravity of the at least one of several determined sections positioned substantially in a center of the sections.

7. A mechanical abutment according to claim 1, wherein notches are formed in edges of the ends of the profile for being used as a housing for a profile bearing axis on which abutment force is applied.

8. A mechanical abutment according to claim 1, wherein the ends of the profile are imbedded in articulated arms (52, 53) on support studs adapted for being actuated along an axis perpendicular to the plane of the preferential zone on either side of which the buckling occurs.

9. A mechanical abutment according to claim 1, wherein the profile is coupled with a resetting member having two arms (81, 82) forming a toggle joint and the arms are shaped according to curvature of the profile in order to straighten it after buckling.

10. A mechanical abutment according to claim 1, wherein the profile is bent, when at rest, over all its length, the at least one triggering element includes means crushing the at least one of several determined sections creating the buckling preferential flexural zone.

11. A mechanical abutment according to claim 1, wherein the profile, which is unbuckled when at rest, is maintained bent over the buckling preferential flexural zone over all a length thereof when in a set position, and the at least one triggering element causing liberation of the at least one of several determined sections.

12. A mechanical abutment according to claim 1, wherein the profile is made of a tube, of reduced thickness, the relaxation being provided by a determined amount of variation of pressure of a fluid contained inside the tube.

13. A mechanical abutment according to claim 1 wherein the profile is arranged so that a direction of its buckling preferential zone, in a set position, makes it to bear on the at least one triggering element, and the at least one triggering element causes an axis of reaction of the profile made by the geometric locus of a center of gravity of the at least one of several sections of the profile along its length, to be rectilinear in the set position, the direction of the buckling in the preferential zone pressing the profile on the at least one triggering element, and in a position of the releasing means to cross direction of the force of the applying means in order to reverse the direction of the buckling in the preferential zone.

14. A mechanical abutment according to claim 1, wherein the bent profile forming the abutment is made lighter in register with its preferential zone by forming in the profile a median hole (12) so as to maintain a center of gravity of the zone substantially in the center of the zone.

15. A releasable mechanical abutment comprising a profile (1, 30, 42, 70, 90, 107) consisting of a resilient and elongated material having a longitudinal axis, the profile adapted for being at least partly bent over itself along the longitudinal axis, and having at least one of several determined sections (10, 38, 50) disposed between ends of the profile, means applying a force exerted on the ends of the profile, and at least one triggering element (22, 46, 64, 76, 93, 113) being adapted for acting generally perpendicularly on the at least one of several determined sections (10, 38, 50) of the profile to provide a deformation of the at least one of several determined sections which defines a preferential flexural zone, in such a manner that abrupt buckling of the profile according to the deformation of the at least one of several determined sections is that it does not exceed a resilient limit of the material, and the at least one triggering element including releasing means (20, 66, 87) for causing an immediate relaxation of the deformation.

16. A mechanical abutment according to claim 15, wherein one of the ends is displaced laterally by a distance e due to the force of the applying means.

* * * * *